US012747636B2

(12) United States Patent
Lockwood

(10) Patent No.: US 12,747,636 B2
(45) Date of Patent: Sep. 29, 2026

(54) EARTH-BORING TOOLS, HYBRID EARTH-BORING TOOLS, AND ASSOCIATED APPARATUS AND METHODS

(71) Applicant: Baker Hughes Oilfield Operations LLC, Houston, TX (US)

(72) Inventor: Nathan S. Lockwood, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 19/062,225

(22) Filed: Feb. 25, 2025

(65) Prior Publication Data

US 2026/0251018 A1 Aug. 27, 2026

(51) Int. Cl.

| | |
|---|---|
| ***E21B 10/14*** | (2006.01) |
| ***E21B 10/16*** | (2006.01) |
| ***E21B 10/43*** | (2006.01) |
| ***E21B 12/02*** | (2006.01) |

(52) U.S. Cl.
CPC ..... *E21B 10/14* (2013.01); *E21B 10/16* (2013.01); *E21B 10/43* (2013.01); *E21B 12/02* (2013.01)

(58) Field of Classification Search
CPC ..... E21B 10/14; E21B 12/02
See application file for complete search history.

(56) References Cited

U.S. PATENT DOCUMENTS

| | | | | |
|---|---|---|---|---|
| 2,198,849 A * | 4/1940 | Waxler | E21B 10/14 | 175/379 |
| 3,055,443 A * | 9/1962 | Edwards | E21B 10/04 | 175/333 |
| 3,174,564 A * | 3/1965 | Morlan | E21B 10/18 | 175/332 |
| 4,892,159 A * | 1/1990 | Holster | E21B 10/14 | 175/336 |
| 5,016,718 A * | 5/1991 | Tandberg | E21B 10/04 | 175/336 |
| 5,145,017 A * | 9/1992 | Holster | E21B 10/14 | 175/336 |
| 7,819,208 B2 | 10/2010 | Pessier et al. | | |
| 7,845,435 B2 | 12/2010 | Zahradnik et al. | | |
| 8,047,307 B2 | 11/2011 | Pessier et al. | | |
| 8,141,664 B2 | 3/2012 | Zahradnik et al. | | |
| 10,107,039 B2 | 10/2018 | Schroder | | |
| 10,190,366 B2 | 1/2019 | Zahradnik et al. | | |

(Continued)

FOREIGN PATENT DOCUMENTS

| | | |
|---|---|---|
| CN | 106320989 A | 1/2017 |
| CN | 213980647 U | 8/2021 |
| WO | 2012/060937 A1 | 5/2012 |

OTHER PUBLICATIONS

International Search Report for Application No. PCT/US2026/016233 dated Jun. 19, 2026, 4 pages.

(Continued)

*Primary Examiner* — Blake Michener
(74) *Attorney, Agent, or Firm* — TraskBritt

(57) ABSTRACT

An earth-boring tool includes a tool body with two or more blades, multiple cutting elements secured to the blades, and at least one roller cone positioned between the blades. The tool includes cutting structures extending from the roller cone, with at least two rows of cutting structures. One of the rows is underexposed and inset from the cutting profile defined by the cutting elements on the blades.

19 Claims, 5 Drawing Sheets

(56) References Cited

U.S. PATENT DOCUMENTS

| | | | | |
|---|---|---|---|---|
| 10,871,036 | B2 | 12/2020 | Zahradnik et al. | |
| 2006/0196699 | A1* | 9/2006 | Estes | E21B 10/04 175/398 |
| 2008/0296068 | A1* | 12/2008 | Zahradnik | E21B 10/16 175/341 |
| 2009/0126998 | A1* | 5/2009 | Zahradnik | E21B 10/43 175/57 |
| 2009/0166093 | A1* | 7/2009 | Pessier | E21B 10/28 175/335 |
| 2010/0155145 | A1 | 6/2010 | Pessier et al. | |
| 2011/0290560 | A1* | 12/2011 | Buske | E21B 12/02 175/39 |
| 2011/0290565 | A1 | 12/2011 | Kulkarni | |
| 2020/0386056 | A1* | 12/2020 | Grosz | E21B 10/20 |
| 2021/0087886 | A1* | 3/2021 | Tu | E21B 10/60 |
| 2024/0328259 | A1* | 10/2024 | Grimes | E21B 10/22 |

OTHER PUBLICATIONS

International Written Opinion for Application No. PCT/US2026/016233 dated Jun. 19, 2026, 5 pages.

* cited by examiner

EARTH-BORING TOOLS, HYBRID EARTH-BORING TOOLS, AND ASSOCIATED APPARATUS AND METHODS

TECHNICAL FIELD

Embodiments of the present disclosure generally relate to earth-boring operations. In particular, embodiments of the present disclosure relate to earth-boring tools, hybrid earth-boring tools and associated apparatus and methods.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. In some cases, earth-boring tools may be configured to drill through plugs (e.g., fracturing plugs, bridge plugs, cement plugs, etc.). In some cases, the plugs may include slips or other types of anchors and the earth-boring tool may be configured to drill through the plug and any slip, anchor, and other component thereof.

Earth-boring tools may include cutting elements and cutting structures formed from abrasive materials having high hardness characteristics. The cutting elements and cutting structures may be configured to engage the formations and additional elements removing material therefrom. Cutting structures in different portions of the earth-boring tools may engage the formations in different ways, which may result in cutting structures on some portions of the earth-boring tool wearing at different rates. This may result in cutting structures in some portions of the earth-boring tools failing earlier than others or failing prematurely, which may result in significant losses of time reducing the efficiency and increasing the costs of a drilling operation.

BRIEF SUMMARY

Some embodiments of the disclosure include an earth-boring tool. The earth-boring tool includes a tool body including two or more blades. The earth-boring tool further includes multiple cutting elements secured to the two or more blades, the multiple cutting elements defining a cutting profile of the earth-boring tool. The earth-boring tool also includes at least one roller cone positioned between the two or more blades. The at least one roller cone includes cutting structures extending from the at least one roller cone, the cutting structures arranged in at least two rows of cutting structures, where at least one row cutting structures of the at least two rows of cutting structures is underexposed, such that the cutting structures in the at least one row of cutting structures are inset from the cutting profile defined by the multiple cutting elements secured to the two or more blades.

Another embodiment of the disclosure includes a method of forming an earth-boring tool. The method includes forming a tool body including at least one blade, the at least one blade defining a cutting profile of the earth-boring tool. The method also includes identifying an area of interest in the tool body. The method further includes forming a roller cone including cutting structures extending therefrom, the cutting structures defining a roller cone cutting profile, the roller cone cutting profile including an exposed region and an underexposed region. The method also includes rotatably attaching the roller cone to the tool body, the roller cone positioned such that the underexposed region of the roller cone cutting profile is at a same radial distance from an axis of the tool body as the area of interest.

Other embodiments of the disclosure include a method of drilling a wellbore. The method includes drilling a wellbore in a formation with an earth-boring tool, the earth-boring tool having a cutting profile defined by cutting elements secured to blades of the earth-boring tool and a roller cone including cutting structures defining a roller cone cutting profile, where a recessed portion of the roller cone cutting profile is inset from the cutting profiled defined by the cutting elements secured to the blades of the earth-boring tool. The method further includes removing the earth-boring tool from the wellbore when the cutting structures in the recessed portion of the roller cone cutting profile engage the formation and reduce a rotational resistance of the earth-boring tool.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
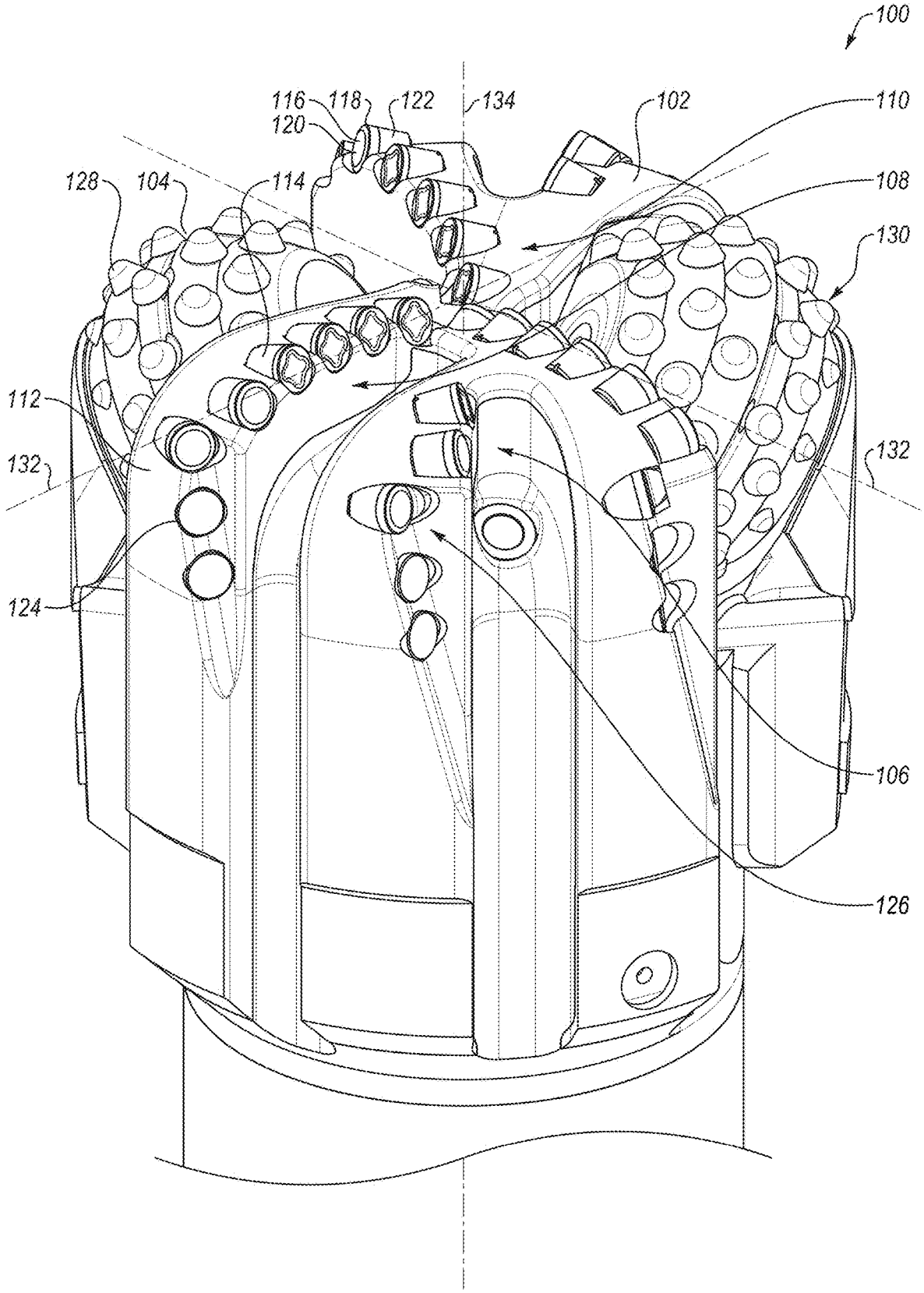
FIG. 1 illustrates a perspective view of an earth-boring tool in accordance with an embodiment of the present disclosure.

The illustrations presented herein are not meant to be actual views of any particular earth-boring system or component thereof but are merely idealized representations employed to describe illustrative embodiments. The drawings are not necessarily to scale.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, terms such as ahead and behind are used in reference to a direction of movement of the associated element. For example, as a drill string moves into a borehole the bottom of the borehole is ahead of the elements of the drill string and the surface is behind the elements of the drill string. In another example, in relation to a cutting element on a rotating earth-boring tool a portion of the formation that has not yet been contacted by the cutting element is ahead of the cutting element whereas a portion of the formation that has already been contacted by the cutting element is behind the cutting element.

As used herein, the term "and/or" means and includes any and all combinations of one or more of the associated listed items.

As used herein, the terms "vertical" and "lateral" refer to the orientations as depicted in the figures.

As discussed above, cutting elements and cutting structures in different portions of the earth-boring tools may engage the formations in different ways, which may result in cutting structures on some portions of the earth-boring tool wearing at different rates. For example, cutting elements are configured to remove material from the formation as the cutting elements slide against the formation with the rotation of the earth-boring tool. Cutting structures extending from roller cones are configured to penetrate the formation while remaining substantially stationary fracturing the formation before being removed from the formation by the rotation of the roller cone. When cutting structures of a roller cone slide against the formation, the cutting structures may wear more quickly than the cutting elements.

In areas having higher stresses, such as a shoulder region of an earth-boring tool, the density of the cutting elements may be increased by changing a profile of the earth-boring tool to increase an operable lifespan of the earth-boring tool. However, changing the profile of the earth-boring tool may increase the amount of sliding experienced by the cutting structures extending from roller cones attached to the earth-boring tool, which may result in increased wear of the cutting structure. Embodiments of the disclosure facilitate forming earth-boring tools with profiles that facilitate increasing the operating lifespan of cutting elements without increasing the sliding experienced by the cutting structures, such that the operating lifespan of the earth-boring tool as a whole is increased.

Figure 2:
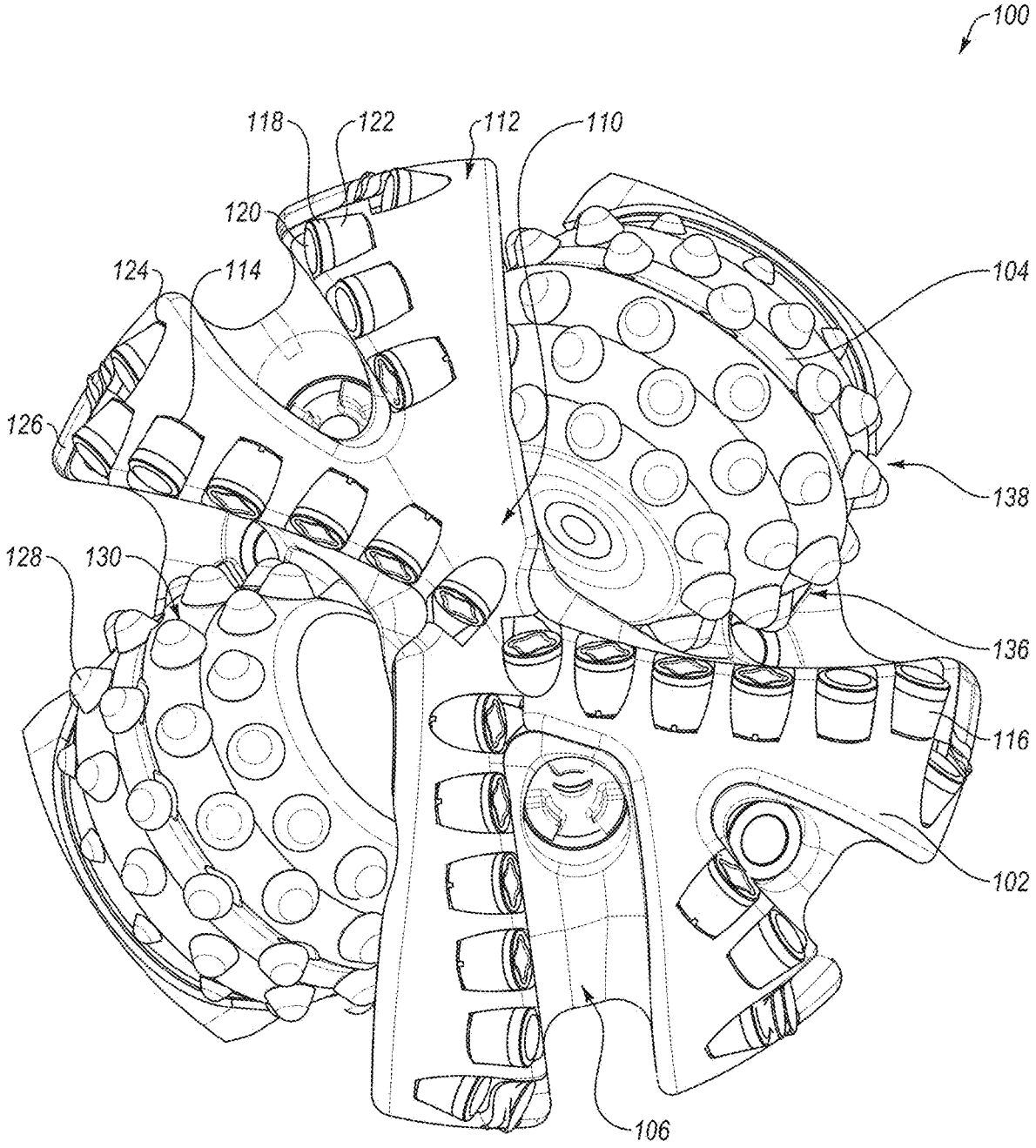
FIG. 2 illustrates a top-down view of the earth-boring tool of FIG. 1.

FIGS. 1 and 2 illustrate views of an embodiment of an earth-boring tool 100. FIG. 1 illustrates a perspective side view of the earth-boring tool 100. FIG. 2 illustrates a top-down view of the earth-boring tool 100.

The earth-boring tool 100 may include one or more blades 102 arranged about the body of the earth-boring tool 100. As illustrated in FIG. 1, some embodiments of the earth-boring tool 100 may include one or more roller cones 104, such as a hybrid bit or a roller cone bit. The blades 102 and/or roller cones 104 may be separated by junk slots 106. In some embodiments, the junk slots 106 include nozzles configured to supply a fluid (e.g., discharge a fluid), such as water, drilling mud, etc., into the junk slots 106.

The blades 102 may include a face 108, a nose region 110 and a shoulder region 112. The face 108 may be oriented to face the area ahead of the blade 102. The nose regions 110 of each of the blades 102 may converge proximate a center of the earth-boring tool 100. The shoulder region 112 may include the radially outer region of the blade 102. The blade 102 may include multiple cutter pockets 114 formed along an edge of the face 108 of the blade 102. The cutter pockets 114 may be configured to receive cutting elements, such as polycrystalline diamond compact (PDC) cutting elements.

The cutting elements 116 may have a cutting table 118 with a cutting face 120 which may form the cutting edge of the blade 102. The cutting elements 116 may also include a substrate 122 configured to support the cutting table 118. The substrate 122 may be secured to the cutter pocket 114 in the blade 102, such as through welding, soldering, brazing, etc., securing the cutting elements 116 to the blade 102. The cutting elements 116 may be arranged such that a cutting face 120 of the cutting elements 116 are in substantially the same plane as the face 108 of the blade 102.

The earth-boring tool 100 may rotate about a longitudinal axis 134 of the earth-boring tool 100. When the earth-boring tool 100 rotates the cutting face 120 of the cutting elements 116 may contact the earth formation and remove material. The material removed by the cutting faces 120 may then be removed through the junk slots 106. As discussed above, the earth-boring tool 100 may include nozzles which may introduce fluid, such as water or drilling mud, into the area around the blades 102 to aid in removing the sheared material and other debris from the area around the blades and/or to cool the cutting elements 116 and the blade 102 to increase the efficiency of the earth-boring tool 100.

The roller cones 104 may include cutting structures 128 extending from the surface of the roller cones 104. The cutting structures 128 may be inserts formed from a material having high hardness, such as steel, tungsten carbide, or polycrystalline diamond. The cutting structures 128 may be arranged in rows 130 extending around the surface of the roller cones 104. When the earth-boring tool 100 rotates, the cutting structures 128 in contact with the formation may puncture the formation and cause the roller cones 104 to rotate about a roller cone axis 132, while the individual cutting structures 128 remain substantially stationary relative to the formation until the rotation of the roller cone 104 pulls the cutting structures 128 out of contact with the formation. A major dimension (e.g., radius, diameter, etc.) of the roller cone 104 may increase as a radial distance from the longitudinal axis 134 of the earth-boring tool 100 increases, such that a roll ratio of the cutting structures 128 of the roller cone 104 are substantially the same at each radial distance from the longitudinal axis 134 while the earth-boring tool 100 rotates.

The roll ratio of cutting structures 128 on the roller cone 104 at each radial distance from the longitudinal axis 134 may be defined as the ratio of a distance of rotation of the position (e.g., the position corresponding to the distal end of one of the cutting structures 128) about the longitudinal axis 134 (e.g., a distance of the rotation of the radial position corresponding to the distal end of one of the cutting structures 128 about the longitudinal axis 134) as compared to a distance of rotation of the position about the roller cone axis 132 (e.g., a distance of the rotation of the position corresponding to a distal end of one of the cutting structures 128 about the roller cone axis 132). For example, the roll ratio for a distal end of a given cutting structure 128 may be determined as follows:

$$\text{Roll Ratio "}RR\text{"} = \frac{\text{Circumference of rotation about drill bit axis}}{\text{Circumference of rotation about roller cone axis}}$$

The shoulder region 112 of at least some of the blades 102 may include shoulder cutter pockets 114. The shoulder cutter pockets 114 may also be configured to receive cutting elements 116. In some cases, the cutting elements 116 may be arranged such that a cutting face 120 of the cutting elements 116 are in substantially the same plane as the face 108 of the blade 102.

One or more of the blades 102 may include recessed shoulder cutter pockets 124. The recessed shoulder cutter pockets 124 may be defined in the outer surface of the shoulder region 112 a distance behind the face 108 of the blade 102. The recessed shoulder cutter pockets 124 may be configured to receive cutting elements 116. Due to the distance between the face 108 of the blade 102 and the recessed shoulder cutter pockets 124, the cutting faces 120 of the cutting elements 116 arranged in the recessed shoulder cutter pockets 124 may be a distance behind the face 108 of the blade 102. The surface of the blade 102 in the shoulder region 112 ahead of the recessed shoulder cutter pockets 124 may form a recess 126 such that the cutting faces 120 of the cutting elements 116 arranged in the recessed shoulder cutter pockets 124 may engage the formation.

The recess 126 and the recessed shoulder cutter pockets 124 may facilitate positioning the more cutting elements 116 and/or cutting surface area to be positioned in the shoulder region 112 of the blade 102. Having more cutting elements 116 may decrease the amount of material being removed by each individual cutting element 116 increasing the life of the cutting elements 116. In some cases, having more cutting elements 116 in the shoulder region 112 may generate more side cutting force that may improve control of the earth-boring tool 100, such as steerability, responsiveness to different formation materials, etc.

The density of cutting elements 116 in the shoulder region 112 of the blades 102 may be further increased by increasing a radius of a cutting profile of the blades 102 in the shoulder region. When the radius of the cutting profile of the blades 102 is changed, a shape of the roller cones 104 may also be changed. As the radius of the cutting profile increases, the major dimension of the roller cone 104 in similar radial positions may decrease, such that the roller cone 104 also includes a nose region 136 and a shoulder region 138 to substantially match the cutting profile of the blades 102. Reducing the major dimension of the roller cone 104 in the shoulder region 138 of the roller cone 104 may increase a difference between the roll ratio of the associated cutting structures 128 in comparison with the cutting structures 128 in other regions of the roller cone 104. The difference in the roll ratios of the cutting structures 128 may result in increased wear on the cutting structures 128 and/or increased energy consumption reducing the efficiency of a drilling operation. For example, the cutting structures 128 in the shoulder region 138 of the roller cone 104 may slide against the formation rather than remaining substantially stationary relative to the formation. Because the cutting structures 128 of the roller cones 104 are designed to puncture the formation and then be removed from contact with the formation, the sliding contact may increase the wear on the cutting structures 128 and result in premature failure of the roller cones 104 of the earth-boring tool 100. Embodiments of the disclosure provide earth-boring tools 100 that facilitate increasing the radius of the cutting profile of the blades 102 in the shoulder region 112 without increasing the wear on the cutting structures 128 in the shoulder region 112 of the roller cones 104.

Figure 3:
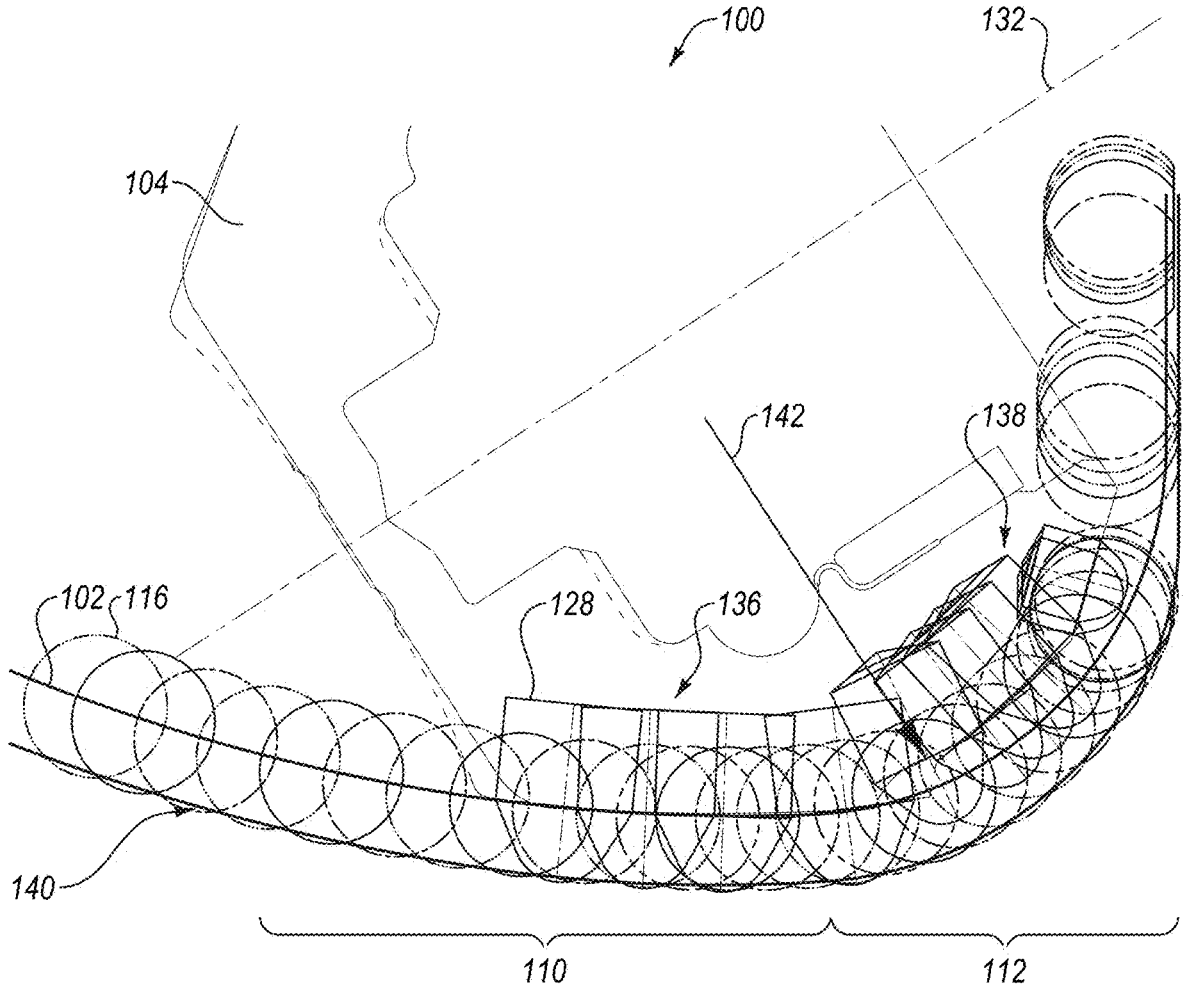
FIG. 3 illustrates a schematic view of a cutting profile of the earth-boring tool of FIG. 1.

FIG. 3 illustrates a schematic view of the earth-boring tool 100 illustrating a cutting profile 140 of the cutting elements 116 of the earth-boring tool 100. The cutting profile 140 is illustrated by showing the path of each of the cutting elements 116 on each of the blades 102 overlaid on the same plane. As illustrated in FIG. 3, the cutting elements 116 extend outward of the blades 102, such that the blades 102 are inset from the cutting profile 140. The blades 102 may be inset from the cutting profile 140 a sufficient distance that the blades 102 are configured to not contact or engage the formation. Insetting the blades 102 from the cutting profile 140 may facilitate reusing the tool body of the earth-boring tool 100 by replacing or re-orienting the cutting elements 116 after the cutting elements 116 become worn without wearing the blades 102 or other portions of the tool body.

As illustrated in FIG. 3, the cutting elements 116 on different blades 102 are offset from one another, such that some of the cutting elements 116 pass through an area between cutting elements 116 of another blade 102. In high stress regions, such as the shoulder region 112 a density of the cutting elements 116 increases, such that a greater number of cutting elements 116 pass through the shoulder region 112 and the offset between the cutting elements 116 on different blades 102 decreases. As discussed above, increasing a radius 142 of the blades 102 in the shoulder region 112 may facilitate positioning a greater number of cutting elements 116 in the shoulder region 112 increasing the density of the cutting elements 116 in the shoulder region 112.

The cutting profile 140 illustrated in FIG. 3 also includes the projected paths of the cutting structures 128 of the roller cone 104. As illustrated the projected paths of at least a portion of the cutting structures 128 are inset from the cutting profile 140 of the cutting elements 116. Insetting some of the cutting structures 128 may reduce wear on the cutting structures 128. In particular, insetting some of the cutting structures 128 may cause the cutting structures 128 to be underexposed reducing contact with the formation for cutting structures 128 that have a roll ratio that is different from the roll ratio of the other cutting structures 128 of the roller cone 104, such that the sliding contact of the cutting structures 128 is substantially reduced or eliminated.

In the embodiment illustrated in FIG. 3, the cutting elements 116 in the shoulder region 138 of the roller cone 104 are inset from the cutting profile 140 of the cutting elements 116 in the corresponding shoulder region 112 of the blades 102. Thus, the cutting structures 128 in the nose region 136 extend to the cutting profile 140 and contact the formation causing the roller cone 104 to rotate about the roller cone axis 132 while the cutting structures 128 in the shoulder region 138 do not contact the formation. In other embodiments, a different portion of the cutting structures 128 of the roller cone 104 may be inset from the cutting profile 140 of the cutting elements 116. For example, the cutting structures 128 in the nose region 136 may be inset from the cutting profile 140 of the cutting elements 116 and the cutting structures 128 in the shoulder region 138 may extend to the same cutting profile 140 as the cutting elements 116 in the corresponding shoulder region 112 of the blades 102. Thus, the cutting structures 128 in the shoulder region 138 may contact the formation and cause the roller cone 104 to rotate about the roller cone axis 132 and the cutting structures 128 in the nose region 136 do not contact the formation.

Figure 4:
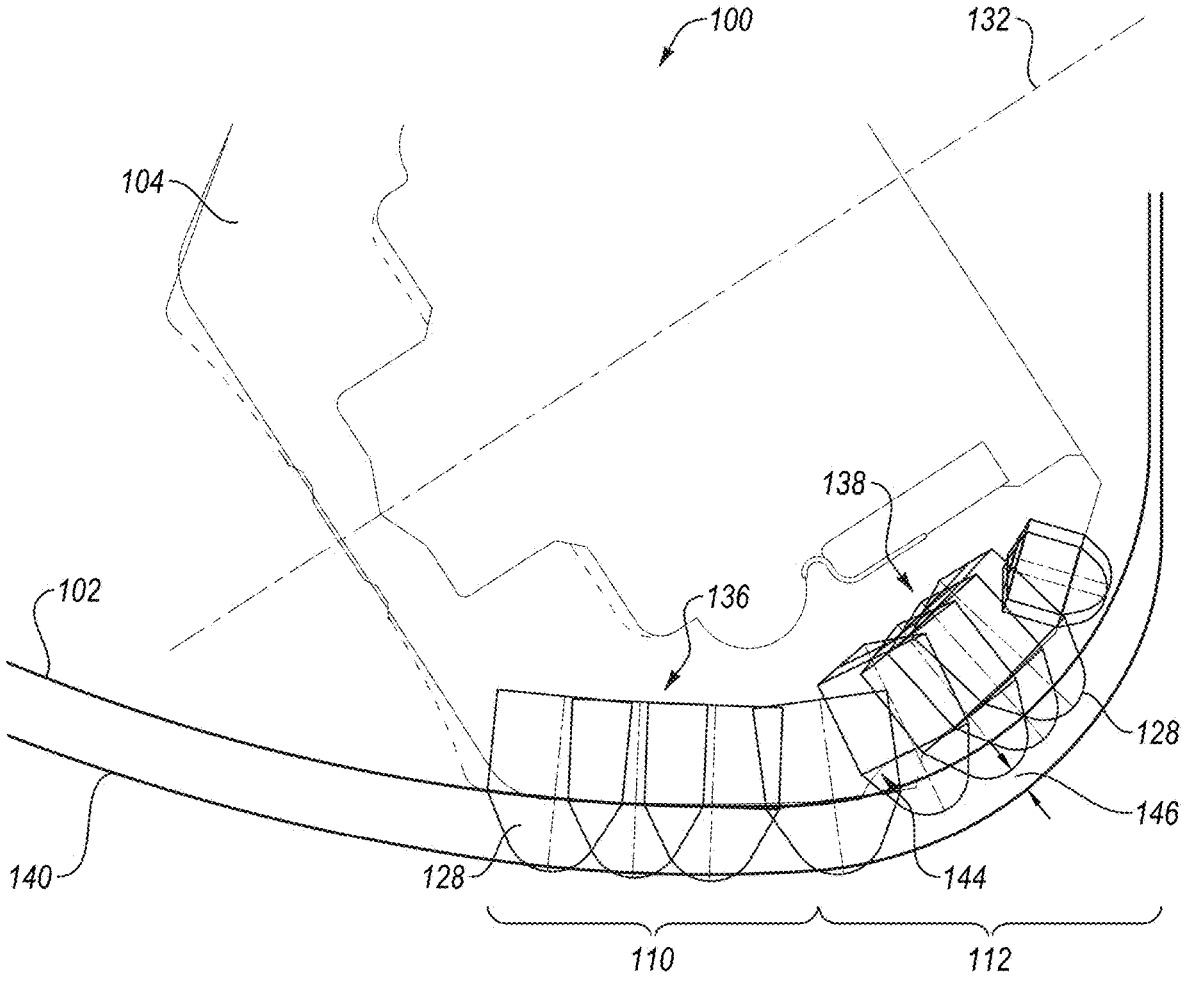
FIG. 4 illustrates a simplified schematic view of the cutting profile of FIG. 3.

FIG. 4 illustrates a simplified schematic view of the cutting profile 140 of the earth-boring tool 100 with the individual cutting elements 116 removed to better illustrate the relationship between the cutting structures 128 of the roller cone 104 and the cutting profile 140. As illustrated in FIG. 4, the roller cone 104 includes a shoulder region 138 where a major dimension of the roller cone 104 reduces, such that an outer surface of the roller cone 104 has a similar arcuate cross-section to that of a profile of the blade 102 in the shoulder region 112 (e.g., a longitudinal cross-section of the roller cone 104 exhibits an arc shape substantially the same as a profile of the blade 102). The outer surface of the roller cone 104 may include a recess 144 at the transition from the nose region 136 of the roller cone 104 to the shoulder region 138 of the roller cone 104. The recess 144 may facilitate insetting the cutting structures 128 in the recessed portion of the outer surface of the roller cone 104 relative to the cutting profile 140.

In the embodiment illustrated in FIG. 4, the recess 144 is arranged, such that the outer surface of the roller cone 104 in the shoulder region 138 is recessed relative to the outer surface of the roller cone 104 in the nose region 136. Thus, the cutting structures 128 in the shoulder region 138 of the roller cone 104 are inset relative to the cutting profile 140. In other embodiments, the recess 144 may be arranged, such that the outer surface of the roller cone 104 in the nose region 136 is recessed relative to the outer surface of the roller cone 104 in the shoulder region 138, such that the cutting structures 128 in the nose region 136 of the roller cone 104 are inset relative to the cutting profile 140.

The recessed portion of the outer surface of the roller cone 104 may result in the cutting structures 128 in the recessed portion being inset by an inset distance 146 greater than a designed depth of cut of the earth-boring tool 100, such as at least about one and one half times (1.5X) the designed depth of cut, at least about two times (2X) the depth of cut, or at least about two and one half times (2.5X) the designed depth of cut. Thus, the cutting structures 128 that are inset may be arranged to not contact the formation during drilling. In some embodiments, the inset distance 146 may be in a range from about ⅛ of a major dimension (e.g., diameter or width) of the cutting elements 116 to about ½ of the major dimension of the cutting elements 116, such as from about ¼ of the major dimension of the cutting elements 116 to about ½ of the major dimension of the cutting elements 116.

The inset distance 146 is less than the inset of the blades 102, such that the cutting structures 128 in the recessed portion of the roller cone 104 are configured to contact the formation before the blades 102 contact the formation. As the cutting elements 116 (FIGS. 1-3) wear, the inset cutting structures 128 may begin to contact the formation. The contact may be measured at the surface through a decrease in rotational resistance due to the increased contact of the cutting structures 128 of the roller cone 104 of the earth-boring tool 100. The rotational resistance may be measured as a decrease in torque. For example, the contact of the inset cutting structures 128 with the formation may reduce the rate of penetration (ROP) of the earth-boring tool 100. The reduction in ROP will be measured as a reduction in torque at the surface. In some embodiments, the inset cutting structures 128 may be inset by an inset distance 146 such that the inset cutting structures 128 contact the formation when the cutting elements 116 (FIGS. 1-3) reach a replacement threshold amount of wear and before the blades 102 contact the formation. Thus, the decrease in resistance caused by the inset cutting structures 128 may act as a wear indicator indicating that the earth-boring tool 100 should be tripped out of the wellbore for replacement or repair before the blades 102 or any other part of the tool body directly engages the formation.

Figure 5:
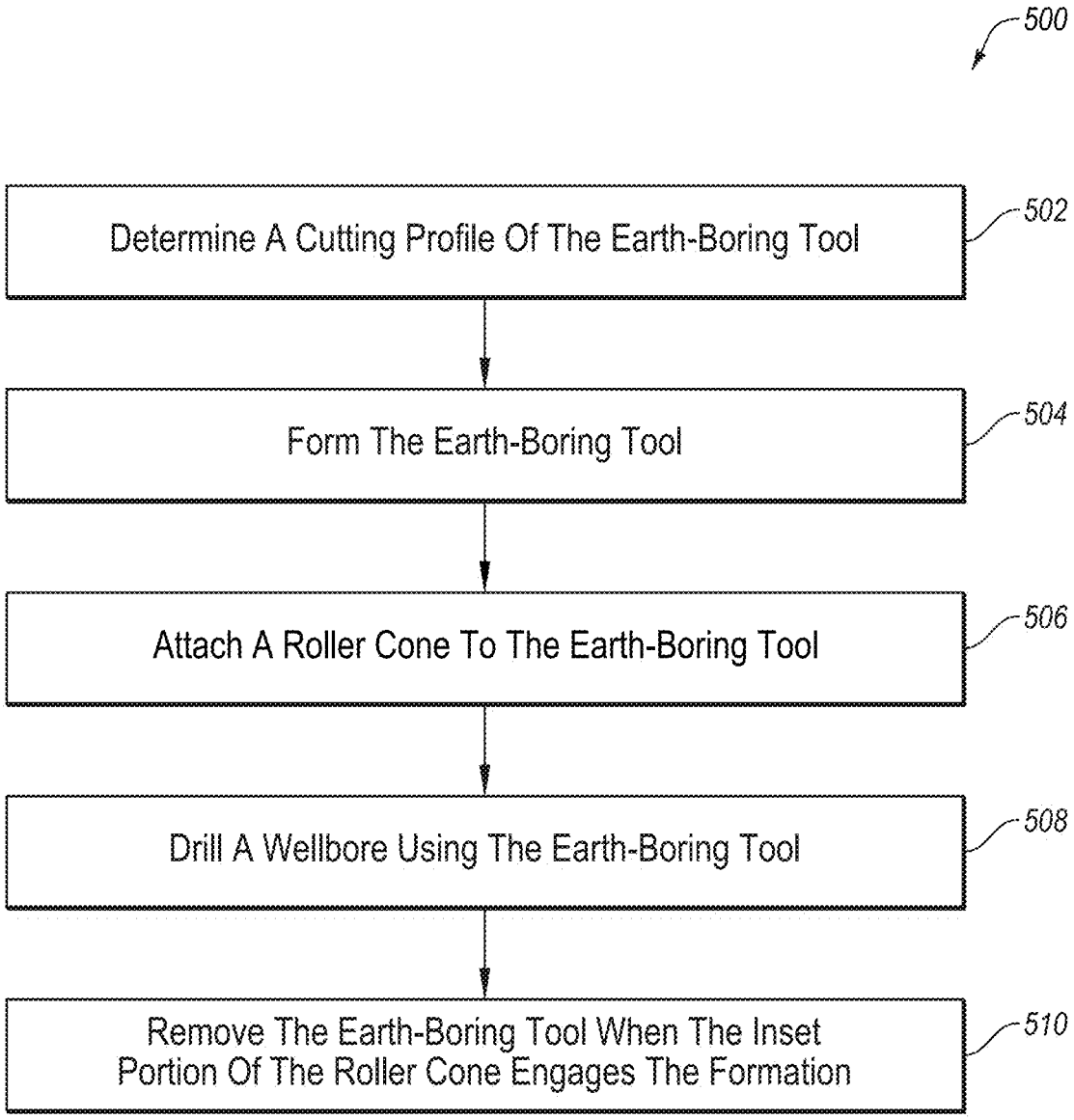
FIG. 5 illustrates a method of drilling a wellbore in accordance with embodiments of the disclosure.

FIG. 5 illustrates a method 500 of determining when to pull or trip an earth-boring tool from a wellbore. A cutting profile of the earth-boring tool may be selected or designed based on the application in act 502. For example, different cutting profiles may be better suited for different types of formations (e.g., sand, silt, mud, gravel, sandstone, granite, etc.). In some embodiments, the cutting profile may be a rounded or dome shape. In other embodiments, the cutting profile may be substantially flat with rounded corner transitions in a shoulder region.

The earth-boring tool may then be formed with blades configured to define the selected cutting profile in act 504. The blades may include multiple cutting elements secured to the blades. The cutting elements are positioned on the blade to form the selected cutting profile, such as the cutting profile 140 illustrated in FIG. 3. The cutting elements may extend away from the blade, such that the blade is inset from the cutting profile. Thus, the cutting elements may be configured to directly contact or engage the formation while the blade is not configured to directly contact the formation.

A roller cone may be rotatably attached to the earth-boring tool in act 506. The roller cone includes cutting structures, such as cutting inserts or protrusions extending from a surface of the roller cone. The roller cone is shaped to substantially match the selected cutting profile. A portion of the cutting profile of the roller cone may be inset from the selected cutting profile of the earth-boring tool, such that the cutting structures extending from the roller cone are not configured to engage the formation. The portion of the cutting profile that is inset may be selected based on an area of interest of the earth-boring tool. For example, the earth-boring tool may include a region that is more easily damaged than other regions of the earth-boring tool or a region that is predicted to be under greater stress than other regions of the earth-boring tool. In some embodiments, the area of interest may be a shoulder region of the earth-boring tool that is under a larger amount of stress compared to other regions of the earth-boring tool. In other embodiments, the area of interest may be a nose region of the earth-boring tool. In some embodiments, a portion of the earth-boring tool may include sensors or other equipment that is more sensitive than other portions of the earth-boring tool and the area of interest may be selected to be the region with the sensitive equipment. The portion of the cutting profile of the roller cone that is inset may be selected to correspond to the area of interest of the earth-boring tool, such that when the inset portion engages the formation, an operator at the surface may be alerted and remove the earth-boring tool before the area of interest engages the formation.

As discussed above, the inset portion of the roller cone may be inset by a distance from the cutting profile of the earth-boring tool that is greater than an expected depth of cut of the earth-boring tool. The depth of cut of the earth-boring tool may depend on multiple factors, such as the type of formation, the weight on bit, the cutting profile, the density of the cutting elements, the size of the cutting elements, etc. As discussed above, the blade may also be inset from the cutting profile by a distance greater than the expected depth of cut of the earth-boring tool, such that the blade does not engage the formation. The distance of the inset portion of the roller cone may be less than the inset of the blade, such that the inset portion of the roller cone is configured to engage the formation before the blade engages the formation.

The earth-boring tool is used to drill a wellbore in act 508. The earth-boring tool may be rotated while a downward pressure is applied to the earth-boring tool. The earth-boring tool is connected to a surface structure, such as a drilling rig, through a drill string. The drill string may be used to transfer the downward pressure and/or the rotation. In some embodiments, a downhole motor, such as a mud motor, may be used to rotate the earth-boring tool in the wellbore. As the earth-boring tool rotates, the cutting elements on the blade may engage the formation and remove material from the formation each rotation in a pattern corresponding to the cutting profile to a depth approximate the expected depth of cut.

The roller cone also engages the formation with the cutting structures that are not in the inset portion. The cutting structures may penetrate the formation to a depth approximately the same as the expected depth of cut fracturing the material of the formation and loosening the material of the formation, such that the loosened material may subsequently be removed by the cutting elements passing through the same area. As the earth-boring tool rotates, the cutting structures may cause the roller cone to rotate, such that subsequent cutting structures penetrate the formation as the roller cone rotates about the roller cone axis. The cutting structures in the inset portion may rotate with the roller cone without engaging the formation. This may facilitate a more complex shape of the roller cone, where the cutting structures in the inset portion have a roll ratio that is substantially different from the roll ratios of other cutting structures of the roller cone.

As the earth-boring tool drills the wellbore, the cutting elements and cutting structures may gradually wear reducing the distance between the cutting profile and the blade. As the distance reduces, the cutting structures in the inset portion of the roller cone may begin to engage the formation. The engagement of the cutting structures in the inset portion may cause a large change in the resistance to rotation of the earth-boring tool. For example, as discussed above, the cutting structures in the inset portion may have a roll ratio that is substantially different from the roll ratios of other cutting structures of the roller cone. This difference in roll ratios may result in the cutting structures in the inset portion sliding against the formation rather than just penetrating and fracturing the formation. The change in resistance may be measured or detected by at least one of the down hole motor or the surface structure.

When the large change in resistance is measured or detected, the earth-boring tool may be removed or tripped out of the wellbore in act 510. For example, the detection of the large change in resistance may trigger an alert to an operator that the earth-boring tool has worn to a threshold level and should be removed for replacement or repair. Thus, the cutting structures of the inset portion of the roller cone may act as a wear indicator alerting an operator when the earth-boring tool has worn to a threshold amount in the area of interest.

Embodiments of the disclosure may facilitate increasing an operational life of an earth-boring tool. For example, embodiments of the disclosure may facilitate using hybrid earth-boring tools with more complex cutting profiles increasing a length of the shoulder region of the earth-boring tool to facilitate a greater number of cutting elements in shoulder regions without excessively wearing other components of the hybrid earth-boring tool.

Embodiments of the disclosure may also facilitate detecting when the earth-boring tool reaches a threshold amount of wear in an area of interest. Detecting the threshold amount of wear may facilitate the removal of the earth-boring tool before the tool body is damaged, such that the earth-boring tool may be repaired, such as by replacing cutting elements. This may reduce costs of a drilling operation at least by facilitating the reuse of the tool body of the earth-boring tool.

Non-limiting example embodiments include:

Embodiment 1: An earth-boring tool, comprising: a tool body comprising two or more blades; multiple cutting elements secured to the two or more blades, the multiple cutting elements defining a cutting profile of the earth-boring tool; at least one roller cone positioned between the two or more blades; cutting structures extending from the at least one roller cone, the cutting structures arranged in at least two rows of cutting structures, wherein at least one row of cutting structures of the at least two rows of cutting structures is underexposed, such that the cutting structures in the at least one row of cutting structures are inset from the cutting profile defined by the multiple cutting elements secured to the two or more blades.

Embodiment 2: The earth-boring tool of embodiment 1, wherein the cutting structures in the at least one row of cutting structures that is underexposed are inset by an inset distance greater than a designed depth of cut of the earth-boring tool.

Embodiment 3: The earth-boring tool of embodiments 1 or 2, wherein the cutting structures in the at least one row of cutting structures that is underexposed are inset by a distance less than a distance between the two or more blades and the cutting profile of the earth-boring tool.

Embodiment 4: The earth-boring tool of any one of embodiments 1 through 3, wherein the at least one row of cutting structures that is underexposed is positioned in a shoulder region of the roller cone.

Embodiment 5: The earth-boring tool of any one of embodiments 1 through 4, wherein the cutting structures in a second row of cutting structures of the at least two rows of cutting structures extend to the cutting profile of the earth-boring tool.

Embodiment 6: The earth-boring tool of any one of embodiments 1 through 5, wherein the at least one roller cone comprises an outer surface and the cutting structures extend from the outer surface of the roller cone.

Embodiment 7: The earth-boring tool of embodiment 6, wherein the outer surface of the at least one roller cone is shaped such that a longitudinal cross-section of the roller cone exhibits an arc shape substantially the same as a profile of the two or more blades.

Embodiment 8: The earth-boring tool of embodiments 6 or 7, wherein the outer surface of the roller cone includes a recessed region and wherein the at least one row of cutting structures that is underexposed extend from the recessed region of the outer surface of the roller cone.

Embodiment 9: The earth-boring tool of any one of embodiments 1 through 8, wherein the at least one row of cutting structures that is underexposed is positioned a same radial distance from a longitudinal axis of the tool body as an area of interest of the tool body and wherein the area of interest is inset a greater distance from the cutting profile than the wherein the at least one row of cutting structures that is underexposed.

Embodiment 10: The earth-boring tool of any one of embodiments 1 through 9, wherein the at least one row of cutting structures that is underexposed is inset from the cutting profile by a distance in a range from about ⅛ of a major dimension of the multiple cutting elements to about ½ of a major dimension of the multiple cutting elements.

Embodiment 11: A method of forming an earth-boring tool, the method comprising: forming a tool body including at least one blade, the at least one blade defining a cutting profile of the earth-boring tool; identifying an area of interest in the tool body; forming a roller cone including cutting structures extending therefrom, the cutting structures defining a roller cone cutting profile, the roller cone cutting profile including an exposed region and an underexposed region; and rotatably attaching the roller cone to the tool body, the roller cone positioned such that the underexposed region of the roller cone cutting profile is at a same radial distance from an axis of the tool body as the area of interest.

Embodiment 12: The method of embodiment 11, further comprising securing multiple cutting elements to the at least one blade, the multiple cutting elements extending from the at least one blade to the cutting profile of the earth-boring tool.

Embodiment 13: The method of embodiment 12, wherein rotatably attaching the roller cone to the tool body, comprises positioning the roller cone such that the underexposed region of the roller cone cutting profile is inset from the cutting profile of the earth-boring tool by a distance in a range from about ⅛ of a major dimension of the multiple cutting elements to about ½ of a major dimension of the multiple cutting elements.

Embodiment 14: The method of any one of embodiments 11 through 13, further comprising: determining a design depth of cut for the earth-boring tool; and positioning the roller cone such that the underexposed region of the roller cone cutting profile is inset from the cutting profile of the earth-boring tool by a distance greater than the design depth of cut for the earth-boring tool.

Embodiment 15: The method of any one of embodiments 11 through 14, wherein rotatably attaching the roller cone to the tool body, comprises positioning the roller cone such that the exposed region of the roller cone cutting profile extends to the cutting profile of the earth-boring tool.

Embodiment 16: A method of drilling a wellbore, the method comprising: drilling a wellbore in a formation with an earth-boring tool, the earth-boring tool having a cutting profile defined by cutting elements secured to blades of the earth-boring tool and a roller cone including cutting structures defining a roller cone cutting profile, where a recessed portion of the roller cone cutting profile is inset from the cutting profile defined by the cutting elements secured to the blades of the earth-boring tool; and removing the earth-boring tool from the wellbore when the cutting structures in the recessed portion of the roller cone cutting profile engage the formation and reduce a rotational resistance of the earth-boring tool.

Embodiment 17: The method of embodiment 16, wherein drilling the wellbore in the formation comprises: puncturing the formation with the cutting structures of the roller cone that define the roller cone cutting profile outside the recessed portion of the roller cone cutting profile; and removing material from the formation with the cutting elements secured to the blades of the earth-boring tool.

Embodiment 18: The method of embodiment 17, wherein puncturing the formation with the cutting structures of the roller cone that define the roller cone cutting profile outside the recessed portion of the roller cone cutting profile comprises: rotating the roller cone relative to the earth-boring tool about a roller cone axis, such that the cutting structures are substantially stationary relative to the formation when puncturing the formation; and rotating the cutting structures in the recessed portion of the roller cone cutting profile, where the cutting structures in the recessed portion of the roller cone cutting profile do not contact the formation.

Embodiment 19: The method of any one of embodiments 16 through 18, wherein removing the earth-boring tool from the wellbore when the cutting structures in the recessed portion of the roller cone cutting profile engage the formation and reduce the rotational resistance of the earth-boring tool comprises: measuring the rotational resistance of the earth-boring tool; and generating an alert when the rotational resistance falls below a threshold resistance.

Embodiment 20: The method of any one of embodiments 16 through 19, wherein removing the earth-boring tool from the wellbore when the cutting structures in the recessed portion of the roller cone cutting profile engage the formation and reduce the rotational resistance of the earth-boring tool comprises removing the earth-boring tool before damaging an area of interest of the earth-boring tool positioned radially proximate the recessed portion of the roller cone cutting profile, wherein the recessed portion of the roller cone cutting profile is inset less than the area of interest.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. An earth-boring tool, comprising:

a tool body comprising two or more blades;

multiple cutting elements secured to the two or more blades, the multiple cutting elements defining a cutting profile of the earth-boring tool;

at least one roller cone positioned between the two or more blades; and cutting structures extending from the at least one roller cone, the cutting structures arranged in at least two rows of exposed cutting structures, and at least two rows of underexposed cutting structures is underexposed, such that the cutting structures in the at least two rows of underexposed cutting structures neighbor one another and are inset from the cutting profile defined by the multiple cutting elements secured to the two or more blades and the cutting structures in the at least two rows of exposed cutting structures extend to the cutting profile defined by the multiple cutting elements secured to the two or more blades.

2. The earth-boring tool of claim 1, wherein the cutting structures in the at least two rows of underexposed cutting structures are inset by an inset distance greater than a designed depth of cut of the earth-boring tool.

3. The earth-boring tool of claim 1, wherein the cutting structures in the at least two rows of underexposed cutting structures are inset by a distance less than a distance between the two or more blades and the cutting profile of the earth-boring tool.

4. The earth-boring tool of claim 1, wherein the at least two rows of underexposed cutting structures are positioned in a shoulder region of the roller cone.

5. The earth-boring tool of claim 1, wherein the at least one roller cone comprises an outer surface and the cutting structures extend from the outer surface of the roller cone.

6. The earth-boring tool of claim 5, wherein the outer surface of the at least one roller cone is shaped such that a longitudinal cross-section of the roller cone exhibits an arc shape substantially the same as a profile of the two or more blades.

7. The earth-boring tool of claim 5, wherein the outer surface of the roller cone includes a recessed region and wherein the at least two rows of underexposed cutting structures extend from the recessed region of the outer surface of the roller cone.

8. The earth-boring tool of claim 1, wherein the at least two rows of underexposed cutting structures are positioned at a same radial distance from a longitudinal axis of the tool body as an area of interest of the tool body and wherein the area of interest is inset a greater distance from the cutting profile than the cutting structures outside the area of interest in the at least two rows of underexposed cutting structures.

9. The earth-boring tool of claim 1, wherein the at least two rows of underexposed cutting structures are inset from the cutting profile by a distance in a range from about ⅛ of a major dimension of the multiple cutting elements to about ½ of a major dimension of the multiple cutting elements.

10. A method of forming an earth-boring tool, the method comprising:

forming a tool body including at least one blade, the at least one blade defining a cutting profile of the earth-boring tool;

identifying an area of interest in the tool body;

forming a roller cone including cutting structures extending therefrom, the cutting structures defining a roller cone cutting profile, the roller cone cutting profile including an exposed region comprising at least two rows of neighboring cutting structures and an underexposed region comprising at least two additional rows of neighboring cutting structures; and rotatably attaching the roller cone to the tool body, the roller cone positioned such that the underexposed region of the roller cone cutting profile is at a same radial distance from an axis of the tool body as the area of interest.

11. The method of claim 10, further comprising securing multiple cutting elements to the at least one blade, the multiple cutting elements extending from the at least one blade to the cutting profile of the earth-boring tool.

12. The method of claim 11, wherein rotatably attaching the roller cone to the tool body, comprises positioning the roller cone such that the underexposed region of the roller cone cutting profile is inset from the cutting profile of the earth-boring tool by a distance in a range from about ⅛ of a major dimension of the multiple cutting elements to about ½ of a major dimension of the multiple cutting elements.

13. The method of claim 10, further comprising:

determining a design depth of cut for the earth-boring tool; and positioning the roller cone such that the underexposed region of the roller cone cutting profile is inset from the cutting profile of the earth-boring tool by a distance greater than the design depth of cut for the earth-boring tool.

14. The method of claim 10, wherein rotatably attaching the roller cone to the tool body, comprises positioning the roller cone such that the exposed region of the roller cone cutting profile extends to the cutting profile of the earth-boring tool.

15. A method of drilling a wellbore, the method comprising:

drilling a wellbore in a formation with an earth-boring tool, the earth-boring tool having a cutting profile defined by cutting elements secured to blades of the earth-boring tool and a roller cone including cutting structures defining a roller cone cutting profile, where a recessed portion of the roller cone cutting profile is inset from the cutting profile defined by the cutting elements secured to the blades of the earth-boring tool; and removing the earth-boring tool from the wellbore when the cutting structures in the recessed portion of the roller cone cutting profile engage the formation and reduce a rotational resistance of the earth-boring tool.

16. The method of claim 15, wherein drilling the wellbore in the formation comprises:

puncturing the formation with the cutting structures of the roller cone that define the roller cone cutting profile outside the recessed portion of the roller cone cutting profile; and removing material from the formation with the cutting elements secured to the blades of the earth-boring tool.

17. The method of claim 16, wherein puncturing the formation with the cutting structures of the roller cone that define the roller cone cutting profile outside the recessed portion of the roller cone cutting profile comprises:

rotating the roller cone relative to the earth-boring tool about a roller cone axis, such that the cutting structures are substantially stationary relative to the formation when puncturing the formation; and rotating the cutting structures in the recessed portion of the roller cone cutting profile, where the cutting structures in the recessed portion of the roller cone cutting profile do not contact the formation.

18. The method of claim 15, wherein removing the earth-boring tool from the wellbore when the cutting structures in the recessed portion of the roller cone cutting profile engage the formation and reduce the rotational resistance of the earth-boring tool comprises:

measuring the rotational resistance of the earth-boring tool; and generating an alert when the rotational resistance falls below a threshold resistance.

19. The method of claim 15, wherein removing the earth-boring tool from the wellbore when the cutting structures in the recessed portion of the roller cone cutting profile engage the formation and reduce the rotational resistance of the earth-boring tool comprises removing the earth-boring tool before damaging an area of interest of the earth-boring tool positioned radially proximate the recessed portion of the roller cone cutting profile, wherein the recessed portion of the roller cone cutting profile is inset less than the area of interest.

* * * * *